US011355058B2

(12) United States Patent
Huang et al.

(10) Patent No.: US 11,355,058 B2
(45) Date of Patent: Jun. 7, 2022

(54) DRIVING PASSIVE LIGHT EMITTING DIODE ARRAY HAVING A DRIVER FOR OUTPUTTING SWITCHING OUTPUT SIGNALS

(71) Applicant: MACROBLOCK. INC., Hsinchu (TW)

(72) Inventors: Ping-Kai Huang, Hsinchu (TW); Chun-Yi Li, Hsinchu (TW)

(73) Assignee: MACROBLOCK. INC., Hsinchu (TW)

( * ) Notice: Subject to any disclaimer, the term of this patent is extended or adjusted under 35 U.S.C. 154(b) by 0 days.

(21) Appl. No.: 17/301,045

(22) Filed: Mar. 23, 2021

(65) Prior Publication Data

US 2021/0304669 A1 Sep. 30, 2021

(30) Foreign Application Priority Data

Mar. 26, 2020 (TW) ..... 109110132

(51) Int. Cl.
*G09G 3/32* (2016.01)
*G09G 3/20* (2006.01)

(52) U.S. Cl.
CPC ..... *G09G 3/32* (2013.01); *G09G 3/2007* (2013.01); *G09G 2300/0809* (2013.01); *G09G 2320/0626* (2013.01)

(58) Field of Classification Search
CPC ..... G09G 3/32
USPC ..... 345/691
See application file for complete search history.

(56) References Cited

U.S. PATENT DOCUMENTS

2007/0120778 A1* 5/2007 Kimura ..... G09G 3/3216 345/76
2008/0186258 A1* 8/2008 Ishimoto ..... G09G 3/3216 345/76
2017/0076666 A1* 3/2017 Kawana ..... G09G 3/3266

FOREIGN PATENT DOCUMENTS

CN 101246669 B 2/2013

OTHER PUBLICATIONS

Search Report appended to an Office Action, which was issued to Taiwanese counterpart application No. 109110132 by the TIPO dated Dec. 3, 2020, with an English translation thereof.

* cited by examiner

*Primary Examiner* — Long D Pham
(74) *Attorney, Agent, or Firm* — MLO, a professional corp.

(57) ABSTRACT

A driving device includes a control unit, a switch unit and a driver unit. The control unit is configured to generate a gray scale output and a synchronization signal. The switch unit is coupled to an LED array, and switches among different conduction states based on a switching output. The driver unit is coupled to the control unit, the switch unit and the LED array. The driver unit generates the switching output based on a clock signal and the synchronization signal, and generates drive outputs for receipt by the LED array based on the clock signal, the gray scale output and the synchronization signal, so as to drive the LED array to emit light.

13 Claims, 6 Drawing Sheets

DRIVING PASSIVE LIGHT EMITTING DIODE ARRAY HAVING A DRIVER FOR OUTPUTTING SWITCHING OUTPUT SIGNALS

CROSS-REFERENCE TO RELATED APPLICATION

This application claims priority of Taiwanese Patent Application No. 109110132, filed on Mar. 26, 2020.

FIELD

The disclosure relates to a driving device, and more particularly to a driving device for driving light emitting diodes.

BACKGROUND

A conventional driving device for driving a light emitting diode (LED) array includes a control unit, a driver unit, and a switch unit including a plurality of switches. The conventional driving device is configured to provide high power output, so the switch unit cannot be integrated into the driver unit.

The control unit generates a gray scale output, a first clock signal, a synchronization signal and a plurality of switching signals. The gray scale output includes a second clock signal, and a serial input signal containing gray scale data. The driver unit is coupled to the control unit and the LED array, receives the gray scale output, the first clock signal and the synchronization signal from the control unit, and operates based on the second clock signal to store the gray scale data contained in the serial input signal. The driver unit generates a drive output for receipt by the LED array based on the first clock signal, the synchronization signal and the gray scale data stored therein. Each of the switches is coupled to the control unit and the LED array, receives a respective one of the switching signals from the control unit, and further receives an input voltage. Each of the switches transitions between conduction and non-conduction based on the respective one of the switching signals, and permits transmission of the input voltage therethrough to the LED array when conducting. The switching signals and the drive output are generated in such a way that the LED array emits light in a line scan manner and has luminous intensity related to the gray scale data.

When a total number of the switches of the switch unit is increased because a total number of LEDs of the LED array is increased, a total number of the switching signals generated by the control unit and a total number of switching output pins of the control unit that respectively output the switching signals have to be increased. However, the control unit is fabricated as a single chip, and has to be redesigned when the total number of the switching output pins thereof is to be changed. In addition, the control unit has to generate the gray scale output, the first clock signal, the synchronization signal and the switching signals, and therefore has a relatively heavy workload.

SUMMARY

Therefore, an object of the disclosure is to provide a driving device that can alleviate at least one drawback of the prior art.

According to the disclosure, the driving device is operatively associated with a light emitting diode (LED) array, and includes a control unit, a switch unit and a driver unit. The control unit is configured to generate a gray scale output and a synchronization signal. The switch unit is adapted to be coupled to the LED array, is to receive a switching output, and is to switch among different conduction states based on the switching output. The driver unit is coupled to the control unit and the switch unit, is adapted to be further coupled to the LED array, and is to receive the gray scale output and the synchronization signal from the control unit. The driver unit generates the switching output for receipt by the switch unit based on a clock signal and the synchronization signal, and generates a plurality of drive outputs for receipt by the LED array based on the clock signal, the gray scale output and the synchronization signal, so as to drive the LED array to emit light.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
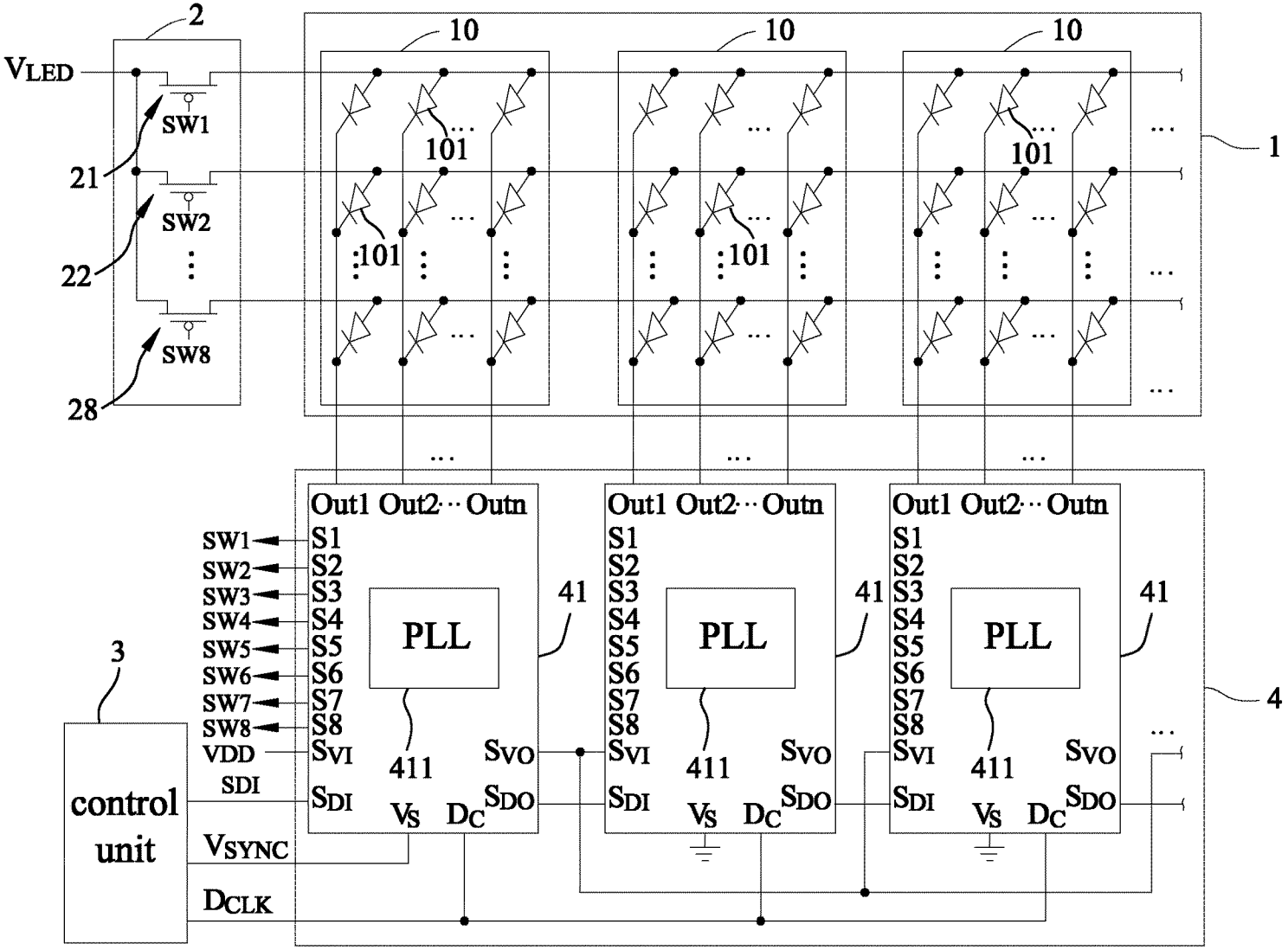
FIG. 1 is a circuit block diagram illustrating a first embodiment of a driving device according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
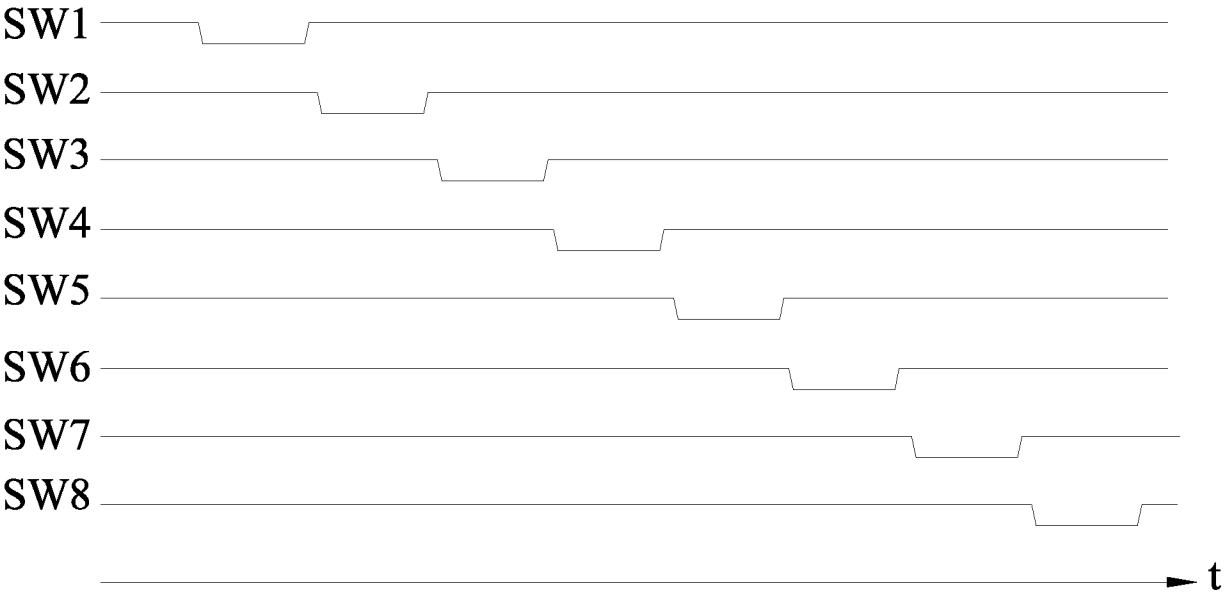
FIG. 2 is a timing diagram illustrating switching signals of the first embodiment.

Referring to FIGS. 1 and 2, a first embodiment of a driving device according to the disclosure is operatively associated with a first light emitting diode (LED) array 1. The first LED array 1 includes a number (M) of LED units 10, where M≥2. Each of the LED units 10 includes a plurality of LEDs 101 arranged in a matrix. Each of the LEDs 101 of the first LED array 1 has a first terminal (e.g., an anode) and a second terminal (e.g., a cathode). The driving device of this embodiment includes a first switch unit 2, a control unit 3, and a first driver unit 4.

The first switch unit 2 is adapted to be coupled to the first LED array 1, is to receive a first switching output, and is to switch among different conduction states based on the first switching output.

In this embodiment, the first switching output includes a number (P) of switching signals, and the first switch unit 2 includes a number (P) of switches, where P≥2. For illustration purposes, P=8 in this embodiment. That is, the first switching output exemplarily includes eight switching signals (SW1-SW8), and the first switch unit 2 exemplarily includes eight switches 21-28. Each of the switching signals (SW1-SW8) is a pulse signal. Each of the switches 21-28 (e.g., a P-type metal oxide semiconductor field effect transistor (pMOSFET)) has a first terminal (e.g., a source terminal) that is to receive an input voltage ($V_{LED}$), a second terminal (e.g., a drain terminal) that is adapted to be coupled to the first terminals of the LEDs 101 in a respective row of every one of the LED units 10, and a control terminal (e.g., a gate terminal) that is to receive a respective one of the switching signals (SW1-SW8). Each of the switches 21-28 transitions between conduction and non-conduction based on the respective one of the switching signals (SW1-SW8), conducts within each pulse of the respective one of the switching signals (SW1-SW8), does not conduct outside the pulses of the respective one of the switching signals (SW1-SW8), and, when conducting, permits transmission of the input voltage ($V_{LED}$) therethrough to the first terminals of the LEDs 101 coupled thereto. In each of the conduction states, at least one of the switches 21-28 conducts while the other one(s) of the switches 21-28, if any, does(do) not conduct. For example, in one of the conduction states, the switch 21 conducts while the switches 22-28 do not conduct.

The control unit 3 (e.g., a controller, a processor or the like) is configured to generate a gray scale output and a synchronization signal ($V_{SYNC}$).

The first driver unit 4 is coupled to the control unit 3 and the control terminals of the switches 21-28, is adapted to be further coupled to the second terminals of the LEDs 101 of the first LED array 1, and is to receive the gray scale output and the synchronization signal ($V_{SYNC}$) from the control unit 3. The first driver unit 4 generates the switching signals (SW1-SW8) for receipt by the control terminals of the switches 21-28 based on a number (M) of first clock signals and the synchronization signal ($V_{SYNC}$), and generates a number (M) of first drive outputs for receipt by the LED units 10 based on the first clock signals, the gray scale output and the synchronization signal ($V_{SYNC}$), so as to drive the first LED array 1 to emit light. In this embodiment, each of the first drive outputs includes a plurality of driving signals, and the switching output and the first drive outputs are generated in such away that the first LED array 1 emits light in a line scan manner (i.e., light emitted in lines) and has luminous intensity related to the gray scale output.

In this embodiment, the gray scale output includes a second clock signal ($D_{CLK}$), and a serial input signal (SDI) containing gray scale data. The first driver unit includes a number (M) of first driver chips 41 respectively corresponding to the LED units 10. Each of the first driver chips 41 includes a phase-locked loop (PLL) 411 generating a respective one of the first clock signals. The first clock signals are substantially the same (i.e., having substantially the same frequency and being substantially synchronous to each other). Each of the first driver chips 41 has a drive output pin set which includes a plurality of drive output pins (Out1-Outn) and at which the first driver chip 4 outputs a respective one of the first drive outputs, a switching output pin set which includes a number (P) of switching output pins (i.e., eight switching output pins (S1-S8)), a control input pin ($S_{VI}$), a control output pin ($S_{VO}$), a gray scale input pin ($S_{DI}$), a gray scale output pin ($S_{DO}$), a synchronization pin ($V_S$), and a clock pin ($D_C$) which is coupled to the control unit 3 to receive the second clock signal ($D_{CLK}$). For any one of the first driver chips 41, each of the drive output pins (Out1-Outn) of the first driver chip 41 is adapted to be coupled to the second terminals of the LEDs 101 in a respective column of one of the LED units 10 that corresponds to the first driver chip 41.

A first one of the first driver chips 41 serves as a master driver chip. For the first one of the first driver chips 41, the switching output pins (S1-S8) thereof are respectively coupled to the control terminals of the switches 21-28, the control input pin ($S_{VI}$) thereof is to receive a predetermined bias voltage (VDD), and the gray scale input pin ($S_{DI}$) thereof and the synchronization pin ($V_S$) thereof are coupled to the control unit 3 to respectively receive the serial input signal (SDI) and the synchronization signal ($V_{SYNC}$). The first one of the first driver chips 41 operates based on the second clock signal ($D_{CLK}$) to store the gray scale data contained in the serial input signal (SDI), and outputs the serial input signal (SDI) at the gray scale output pin ($S_{DO}$) thereof. The first one of the first driver chips 41 generates, based on the first clock signal generated thereby and the synchronization signal ($V_{SYNC}$), a number (P) of output signals (i.e., eight output signals) that respectively serve as the switching signals (SW1-SW8), and outputs the switching signals (SW1-SW8) respectively at the switching output pins (S1-S8) thereof for receipt by the control terminals of the switches 21-28. The first one of the first driver chips 41 generates the driving signals of the respective one of the first drive outputs based on the first clock signal generated thereby, the gray scale data stored therein and the synchronization signal ($V_{SYNC}$), and outputs the driving signals respectively at the drive output pins (Out1-Outn) thereof for receipt by the second terminals of the LEDs 101 of the corresponding LED unit 10. The first one of the first driver chips 41 generates a control signal that contains synchronization pulses of the synchronization signal ($V_{SYNC}$) and a line scan command which indicates when the respective one of the first drive outputs changes, and outputs the control signal at the control output pin ($S_{VO}$) thereof.

Each of second to $M^{th}$ ones of the first driver chips 41 serves as a slave driver chip. For an $m^{th}$ one of the first driver chips 41 (where $2 \leq m \leq M$), the control input pin ($S_{VI}$) thereof is coupled to the control output pin ($S_{VO}$) of the first one of the first driver chips 41 to receive the control signal, the gray scale input pin ($S_{DI}$) thereof is coupled to the gray scale output pin ($S_{DO}$) of an $(m-1)^{th}$ one of the first driver chips 41 to receive the serial input signal (SDI), and the synchronization pin ($V_S$) is coupled to ground. The $m^{th}$ one of the first driver chips 41 operates based on the second clock signal ($D_{CLK}$) to store the gray scale data contained in the serial input signal (SDI), and outputs the serial input signal (SDI) at the gray scale output pin ($S_{DO}$) thereof. The $m^{th}$ one of the first driver chips 41 generates a number (P) of output signals (i.e., eight output signals) based on the first clock signal generated thereby and the control signal, and outputs the output signals respectively at the switching output pins (S1-S8) thereof. In this embodiment, each of the output signals generated by the $m^{th}$ one of the first driver chips 41 and a respective corresponding one of the output signals generated by the first one of the first driver chips 41 are substantially the same (i.e., having substantially the same frequency, and being substantially synchronous to each other), but the disclosure is not limited thereto. The $m^{th}$ one of the first driver chips 41 generates the driving signals of the respective one of the first drive outputs based on the first clock signal generated thereby, the gray scale data stored therein and the control signal, and outputs the driving signals respectively at the drive output pins (Out1-Outn) thereof for receipt by the second terminals of the LEDs 101 of the corresponding LED unit 10.

In this embodiment, the switching signals (SW1-SW8) have the same pulse width, and the pulse width is a multiple of a period of each of the first clock signals. The pulses of the switching signals (SW1-SW8) are staggered and non-overlapping in time (i.e., within each line scan cycle, the pulse of the switching signal (SW1), the pulse of the switching signal (SW2), the pulse of the switching signal (SW3), the pulse of the switching signal (SW4), the pulse of the switching signal (SW5), the pulse of the switching signal (SW6), the pulse of the switching signal (SW7) and the pulse of the switching signal (SW8) occur one by one without overlapping one another in time), and a starting point of each pulse of the switching signal (SW1) is determined by the synchronization signal ($V_{SYNC}$). For any one of the first drive outputs, each of the driving signals of the first drive output has a current magnitude that is related to luminous intensity of light emitted by the LED unit 10 receiving the first drive output, that is determined by the gray scale data stored in the first driver chip 41 generating the first drive output, and that changes upon starting points of the pulses of the switching signals (SW1-SW8). Each of the LEDs 101 of the first LED array 1 emits light when one of the switches 21-28 that is coupled to the LED 101 conducts, and does not emit light when said one of the switches 21-28 does not conduct; and the luminous intensity of the LED 101 is determined by one of the driving signals of the first drive outputs that is received by the LED 101. Since the switches 21-28 conduct one by one (because the pulses of the switching signals (SW1-SW8) are staggered and non-overlapping in time), the LEDs 101 of the first LED array 1 emit light row by row (i.e., the first LED array 1 emits light in the line scan manner).

It should be noted that, in this embodiment, each of the first driver chips 41 generates the respective first clock signal. However, in other embodiments, the first driver unit 4 may generate only one first clock signal for common use by the first driver chips 41.

Figure 3:
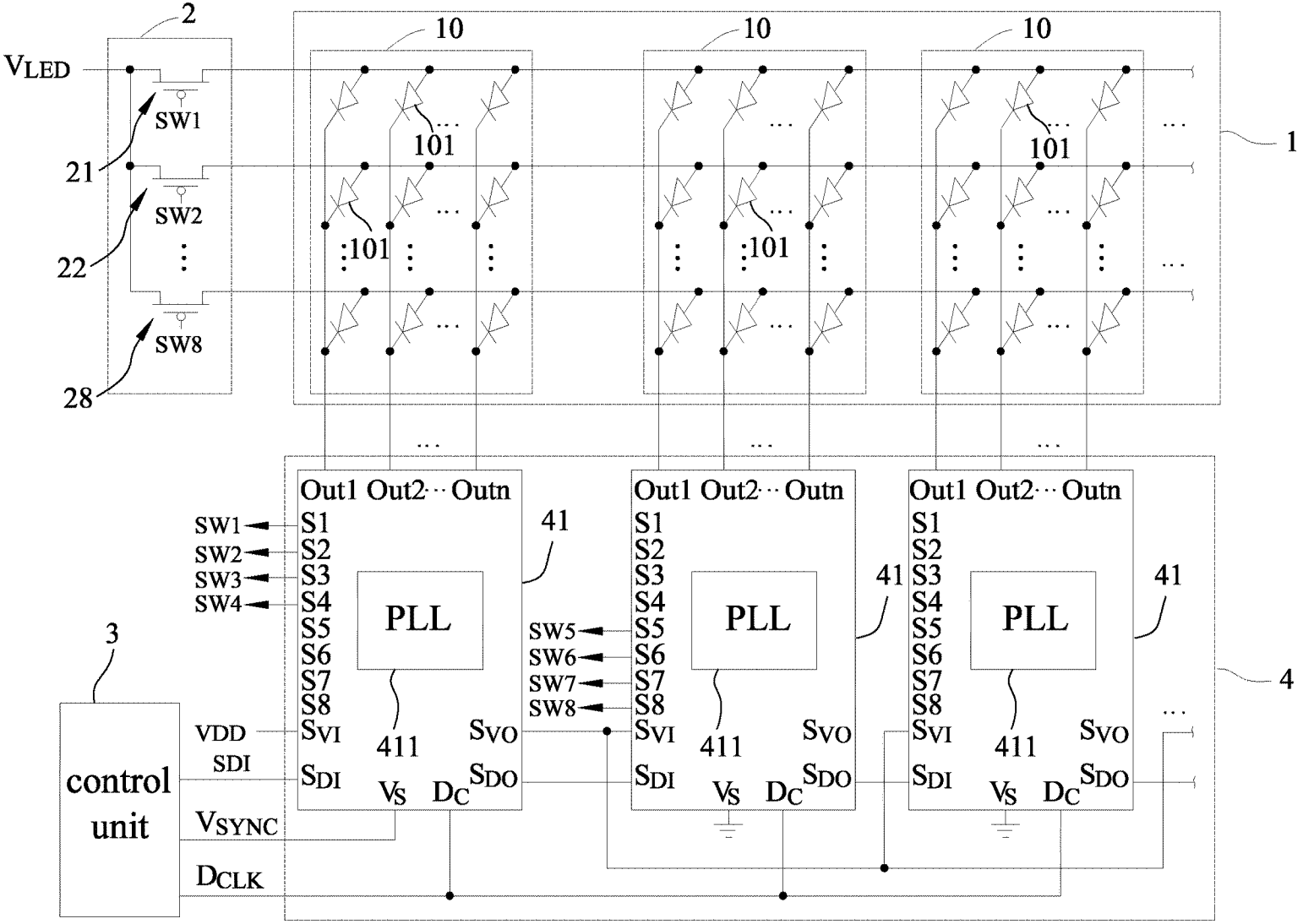
FIG. 3 is a circuit block diagram illustrating a second embodiment of the driving device according to the disclosure.

Referring to FIG. 3, a second embodiment of the driving device according to the disclosure is similar to the first embodiment, and differs from the first embodiment in that the switching signals (SW1-SW8) originate from at least two of the first driver chips 41. In other words, eight of the switching output pins (S1-S8) of the first driver chips 41 which do not all belong to the same first driver chip 41 are respectively coupled to the control terminals of the switches 21-28, and the corresponding output signals, which are respectively provided at these eight switching output pins, respectively serve as the switching signals (SW1-SW8).

In an example as shown in FIG. 3, a first part of the first switching output (e.g., half of the switching signals (SW1-SW4)) is generated by the first one of the first driver chips 41, and a second part of the first switching output (e.g., the other half of the switching signals (SW5-SW8)) is generated by a predetermined one of the second to $M^{th}$ ones of the first driver chips 41 (e.g., the second one of the first driver chips 41). In detail, half of the switching output pins (S1-S4) of the first one of the first driver chips 41 and half of the switching output pins (S5-S8) of the second one of the first driver chips 41 are respectively coupled to the control terminals of the switches 21-28; the first one of the first driver chips 41 generates said half of the switching signals (SW1-SW4), and outputs said half of the switching signals (SW1-SW4) at said half of the switching output pins (S1-S4) thereof for receipt by the control terminals of the switches 21-24; and the second one of the first driver chips 41 generates said other half of the switching signals (SW5-SW8), and outputs said other half of the switching signals (SW5-SW8) at said half of the switching output pins (S5-S8) thereof for receipt by the control terminals of the switches 25-28.

In another example (not shown), a first part of the first switching output (e.g., the switching signals (SW1-SW4)) is generated by the first one of the first driver chips 41, a second part of the first switching output (e.g., the switching signal (SW5)) is generated by the second one of the first driver chips 41, and a third part of the first switching output (e.g., the switching signals (SW6-SW8)) is generated by the third one of the first driver chips 41.

Figure 4:
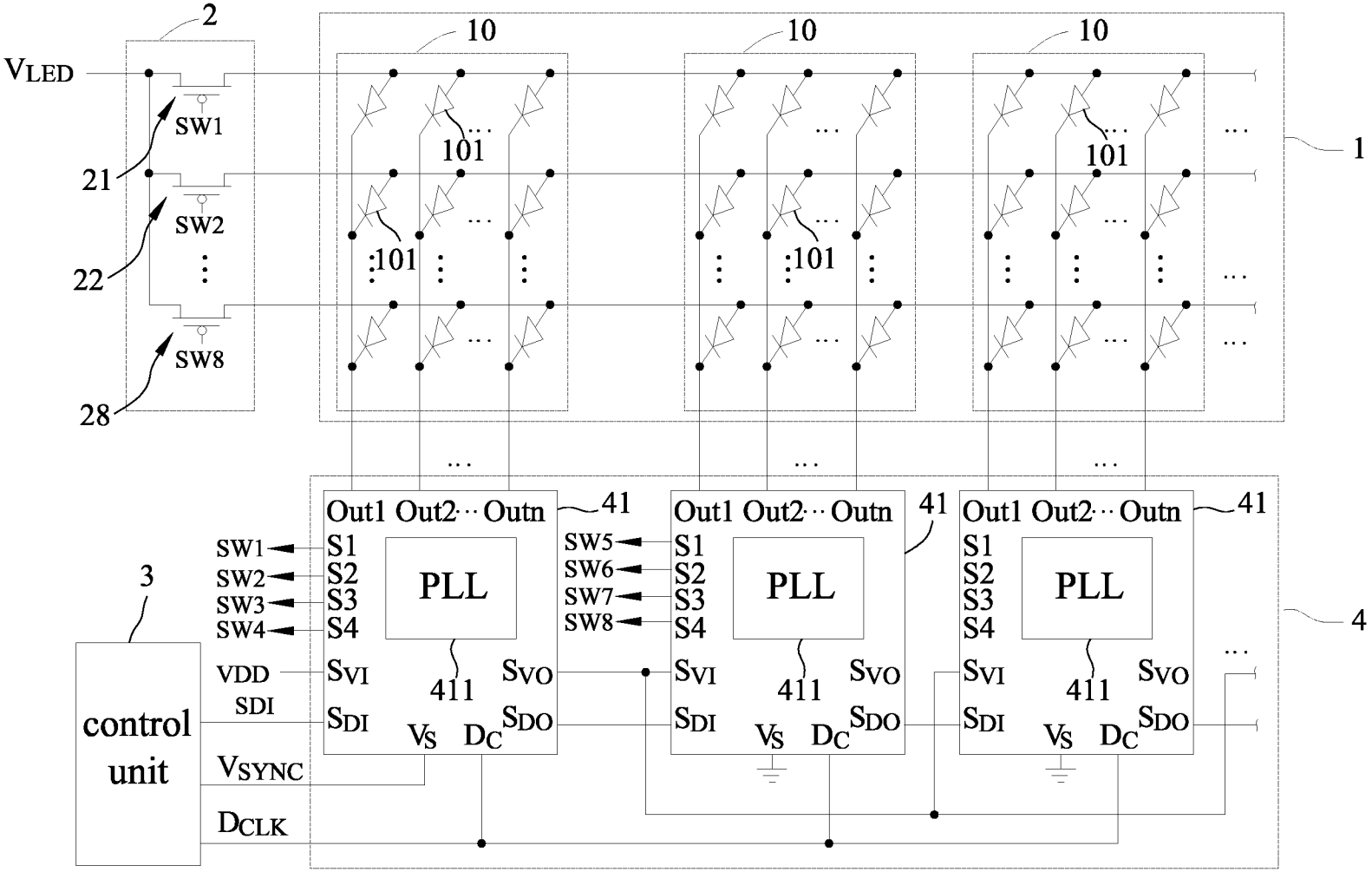
FIG. 4 is a circuit block diagram illustrating a third embodiment of the driving device according to the disclosure.

Referring to FIG. 4, a third embodiment of the driving device according to the disclosure is similar to the second embodiment, and differs from the second embodiment in that: (a) the switching output pin set of each of the first driver chips 41 includes a number (P/2) of switching output pins (i.e., four switching output pins (S1-S4) in the given example); (b) each of the first driver chips 41 generates a number (P/2) of output signals (i.e., four output signals in the given example), and outputs the output signals respectively at the switching output pins (S1-S4) thereof; and (c) the pulses of the output signals generated by a predetermined one of the second to $M^{th}$ ones of the first driver chips 41 are non-overlapping in time with the pulses of the output signals generated by the first one of the first driver chips 41.

In an example as shown in FIG. 4, a first part of the first switching output (e.g., half of the switching signals (SW1-SW4)) is generated by the first one of the first driver chips 41, and a second part of the first switching output (e.g., the other half of the switching signals (SW5-SW8)) is generated by the predetermined one of the second to $M^{th}$ ones of the first driver chips 41 (e.g., the second one of the first driver chips 41). In detail, the switching output pins (S1-S4) of the first and second ones of the first driver chips 41 are respectively coupled to the control terminals of the switches 21-28; the first one of the first driver chips generates said half of the switching signals (SW1-SW4), and outputs said half of the switching signals (SW1-SW4) at the switching output pins (S1-S4) thereof for receipt by the control terminals of the switches 21-24; and the second one of the first driver chips 41 generates said other half of the switching signals (SW5-SW8), and outputs said other half of the switching signals (SW5-SW8) at the switching output pins (S1-S4) thereof for receipt by the control terminals of the switches 25-28.

Figure 5:
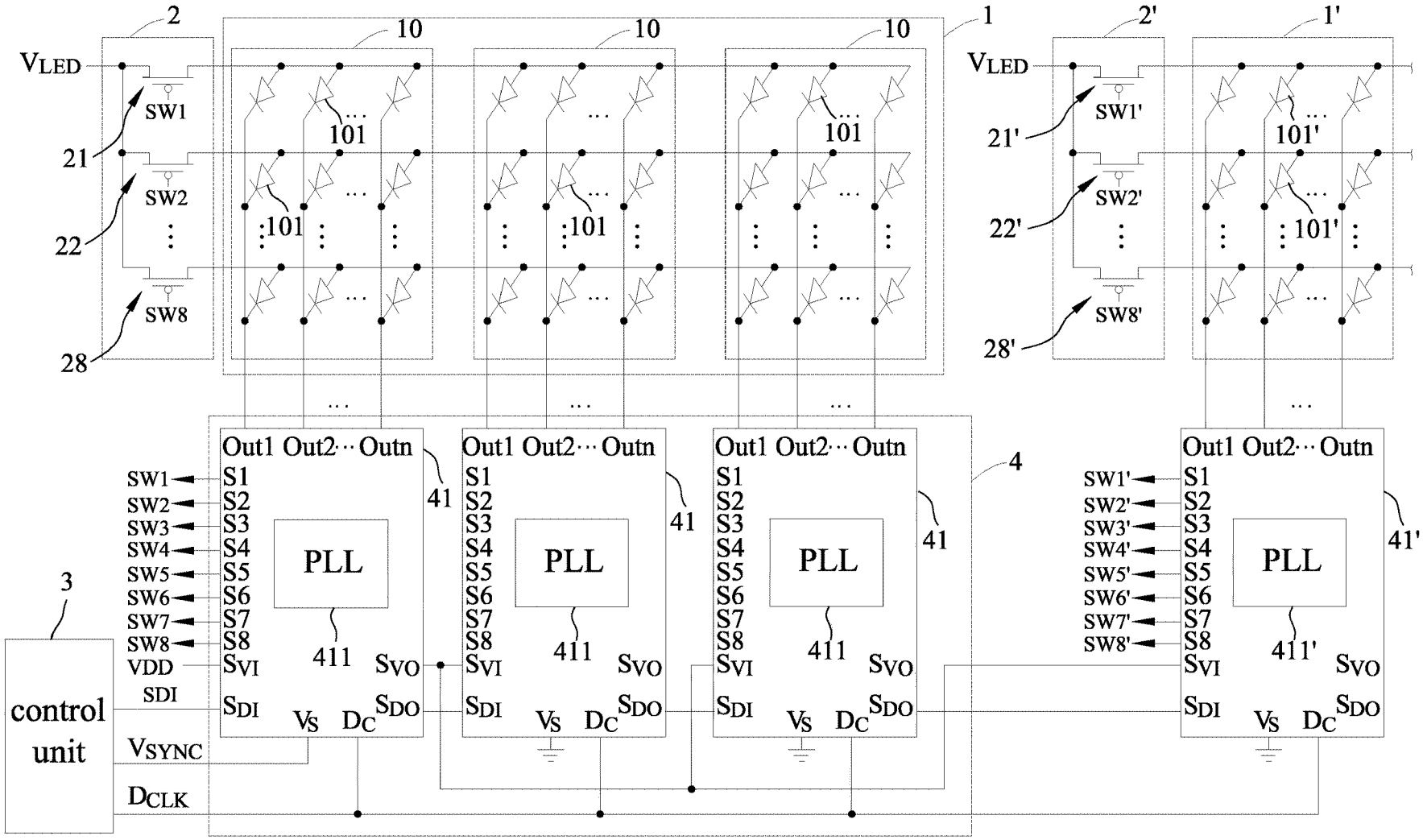
FIG. 5 is a circuit block diagram illustrating a fourth embodiment of the driving device according to the disclosure.

Referring to FIG. 5, a fourth embodiment of the driving device according to the disclosure is similar to the first embodiment, and differs from the first embodiment in that the driving device is further operatively associated with a second LED array 1' and further includes a second switch unit 2' and a second driver chip 41'. The second LED array 1' includes a plurality of LEDs 101' arranged in a matrix. Each of the LEDs 101' has a first terminal (e.g., an anode) and a second terminal (e.g., a cathode).

The second switch unit 2' is adapted to be coupled to the second LED array 1', is to receive a second switching output, and is to switch among different conduction states based on the second switching output.

In this embodiment, the second switching output includes a number (P) of switching signals (i.e., eight switching signals (SW1'-SW8')), and the second switch unit 2' includes a number (P) of switches (i.e., eight switches 21'-28'). Each of the switching signals (SW1'-SW8') is a pulse signal. Each of the switches 21'-28' (e.g., a pMOSFET) has a first terminal (e.g., a source terminal) that is to receive the input voltage ($V_{LED}$), a second terminal (e.g., a drain terminal) that is adapted to be coupled to the first terminals of the LEDs 101' in a respective row, and a control terminal (e.g., a gate terminal) that is to receive a respective one of the switching signals (SW1'-SW8'). Each of the switches 21'-28' transitions between conduction and non-conduction based on the respective one of the switching signals (SW1'-SW8'), conducts within each pulse of the respective one of the switching signals (SW1'-SW8'), does not conduct outside the pulses of the respective one of the switching signals (SW1'-SW8'), and, when conducting, permits transmission of the input voltage ($V_{LED}$) therethrough to the first terminals of the LEDs 101' coupled thereto. In each of the conduction states of the second switch unit 2', at least one of the switches 21'-28' conducts while the other one(s) of the switches 21'-28', if any, does (do) not conduct. For example, in one of the conduction states of second switch unit 2', the switch 21' conducts while the switches 22'-28' do not conduct.

The second driver chip 41' is coupled to the control unit 3, the first driver unit 4 and the second switch unit 2', is adapted to be further coupled to the second LED array 1', is to receive the second clock signal ($D_{CLK}$) from the control unit 3, and is to further receive the serial input signal (SDI) and the control signal from the first driver unit 4. The second driver chip 41' generates the second switching output for receipt by the second switch unit 2' based on a respective first clock signal and the control signal, and generates a second drive output for receipt by the second LED array 1' based on the respective first clock signal, the second clock signal ($D_{CLK}$), the serial input signal (SDI) and the control signal, so as to drive the second LED array 1' to emit light. In this embodiment, the second drive output includes a plurality of driving signals, and the second switching output and the second drive output are generated in such a way that the second LED array 1' emits light in the line scan manner and has luminous intensity related to the gray scale data contained in the serial input signal (SDI).

In this embodiment, the second driver chip 41' includes a PLL 411' generating the respective first clock signal. The first clock signal generated by the PLL 411' of the second driver chip 41' is substantially the same as the first clock signal generated by the PLL 411 of each of the first driver chips 41. The second driver chip 41' serves as a slave driver chip, and has a drive output pin set that includes a plurality of drive output pins (Out1-Outn), a switching output pin set that includes a number (P) of switching output pins (i.e., eight switching output pins (S1-S8)), a control input pin ($S_{VI}$), a control output pin ($S_{VO}$), a gray scale input pin ($S_{DI}$), a gray scale output pin ($S_{DO}$), a synchronization pin ($V_S$) that is coupled to ground, and a clock pin ($D_C$) that is coupled to the control unit 3 to receive the second clock signal ($D_{CLK}$). For the second driver chip 41', each of the drive output pins (Out1-Outn) thereof is adapted to be coupled to the second terminals of the LEDs 101' in a respective column, the switching output pins (S1-S8) thereof are respectively coupled to the control terminals of the switches 21'-28', the control input pin ($S_{VI}$) thereof is coupled to the control output pin ($S_{VO}$) of the first one of the first driver chips 41 to receive the control signal, and the gray scale input pin ($S_{DI}$) thereof is coupled to the gray scale output pin ($S_{DO}$) of the $M^{th}$ one of the first driver chips 41 to receive the serial input signal (SDI). The second driver chip 41' operates based on the second clock signal ($D_{CLK}$) to store the gray scale data contained in the serial input signal (SDI), and outputs the serial input signal (SDI) at the gray scale output pin ($S_{DO}$) thereof. The second driver chip 41' generates the switching signals (SW1'-SW8') based on the first clock signal generated thereby and the control signal, and outputs the switching signals (SW1'-SW8') respectively at the switching output pins (S1-S8) thereof for receipt by the control terminals of the switches 21'-28'. The second driver chip 41' generates the driving signals of the second drive output based on the first clock signal generated thereby, the gray scale data stored therein and the control signal, and outputs the driving signals respectively at the drive output pins (Out1-Outn) thereof for receipt by the second terminals of the LEDs 101'.

In this embodiment, each of the switching signals (SW1'-SW8') and a respective corresponding one of the switching signals (SW1-SW8) are substantially the same (i.e., having substantially the same frequency, and being substantially synchronous to each other). Each of the driving signals of the second drive output has a current magnitude that is related to luminous intensity of light emitted by the second LED array 1', that is determined by the gray scale data stored in the second driver chip 41', and that changes upon starting points of pulses of the switching signals (SW1'-SW8'). Each of the LEDs 101' emits light when one of the switches (21'-28') that is coupled to the LED 101' conducts, and does not emit light when said one of the switches (21'-28') does not conduct; and luminous intensity of the LED 101' is determined by one of the driving signals of the second drive output that is received by the LED 101'. Since the switches 21'-28' conduct one by one (because the pulses of the switching signals (SW1'-SW8') are staggered and non-overlapping in time), the LEDs 101' of the second LED array 1' emit light row by row (i.e., the second LED array 1' emits light in the line scan manner).

When a total number of the LEDs 101, 101' of the first and second LED arrays 1, 1' in the fourth embodiment is equal to a total number of the LEDs 101 of the first LED array 1 in the first embodiment, rated power of each of the switches 21-28, 21'-28' of the fourth embodiment can be smaller than rated power of each of the switches 21-28 of the first embodiment.

Figure 6:
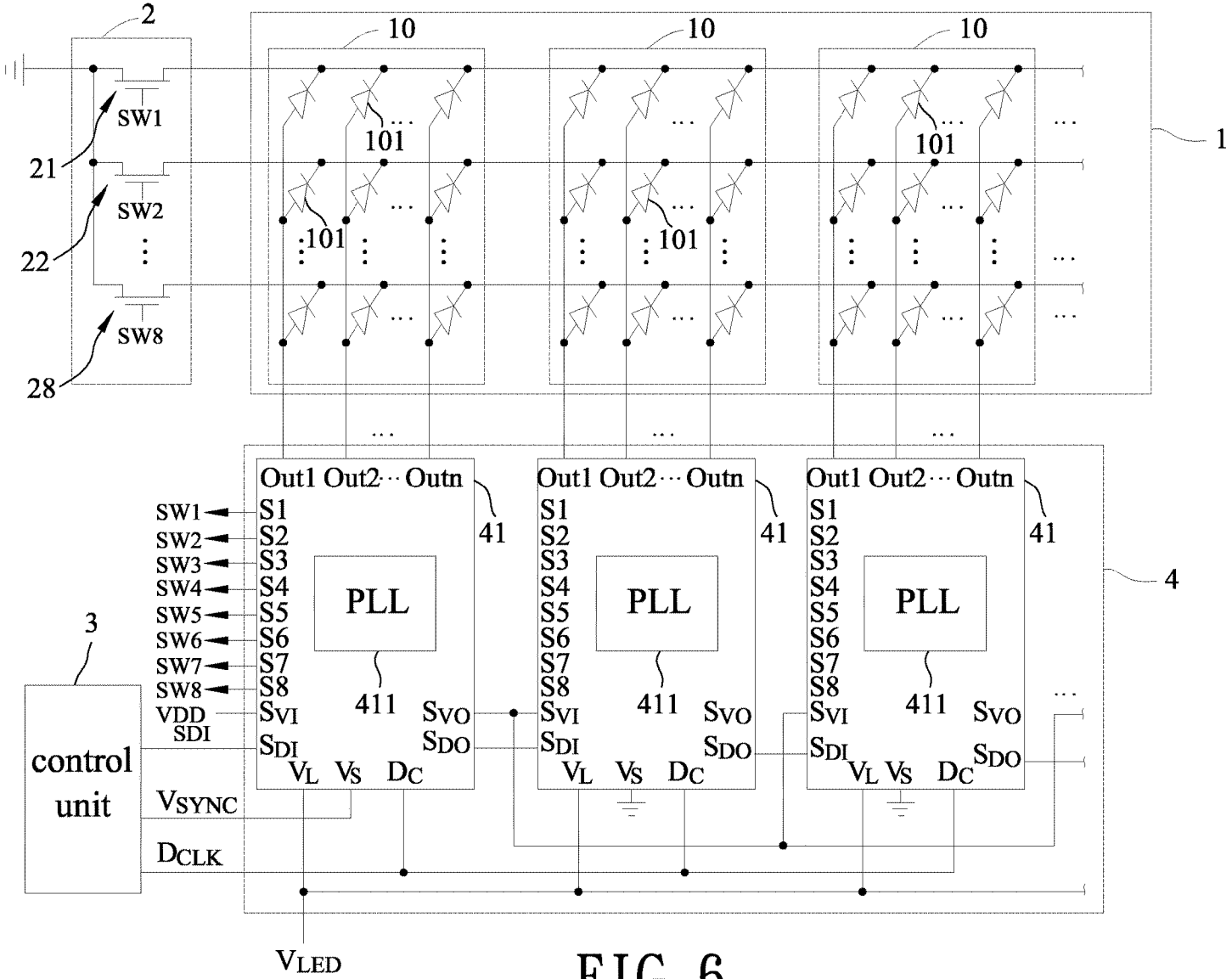
FIG. 6 is a circuit block diagram illustrating a fifth embodiment of the driving device according to the disclosure.

Referring to FIG. 6, a fifth embodiment of the driving device according to the disclosure is similar to the first embodiment, and differs from the first embodiment in that: (a) the first terminal of each of the LEDs 101 of the first LED array 1 is the cathode, instead of the anode; (b) the second terminal of each of the LEDs 101 of the first LED array 1 is the anode, instead of the cathode; (c) each of the switches 21-28 is an N-type metal oxide semiconductor field effect transistor (nMOSFET), instead of the pMOSFET; (d) the first terminal of each of the switches 21-28 is to receive a ground voltage, instead of the input voltage ($V_{LED}$); and (e) each of the first driver chips 41 further includes a supply input pin ($V_L$) to receive the input voltage ($V_{LED}$), and is to acquire the respective one of the first drive outputs from the input voltage ($V_{LED}$).

Referring to FIGS. 1 and 3 to 6, in view of the above, for each of the first to fifth embodiments, since the first driver chips 41 are separate components, and since each of the first driver chips 41 can generate the switching signals, when the total number of the switches of the first switch unit 2 is increased to accommodate an increased total number of the LEDs 101 of the first LED array 1, the first driver chips 41 originally included in the first driver unit 4 are able to generate the switching signals for controlling all the switches of the first switch unit 2, or an additional first driver chip 41 can be added to the first driver unit 4 to assist in generating the switching signals for controlling the switches of the first switch unit 2, thereby preventing the redesigning of the control unit 3. Specifically, for the fourth embodiment, when the total number of the switches of the second switch unit 2' is increased because the total number of the LEDs 101' of the second LED array 1' is increased, an additional second driver chip 41' can be included in the second driver unit 4' to assist in generating the switching signals for controlling the switches of the second switch unit 2', thereby preventing the redesigning of the control unit 3. In addition, for each of the first to fifth embodiments, the control unit 3 has a relatively lighter workload since it does not need to generate the first clock signals required by the driver chips 41 and/or 41' and the switching signals (SW1-SW8 and/or SW1'-SW8') for controlling the switches 21-28 and/or 21'-28'.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that the disclosure is not limited to the disclosed embodiments but is intended to cover various arrangements included within the spirit and scope of the broadest interpretation so as to encompass all such modifications and equivalent arrangements.

What is claimed is:

1. A driving device operatively associated with a first light emitting diode (LED) array, and comprising:

a controller configured to generate a gray scale output and a synchronization signal;

a first switch adapted to be coupled to the first LED array, to receive a first switching output, and to switch among different conduction states based on the first switching output; and a first driver coupled to said controller and said first switch, adapted to be further coupled to the first LED array, and to receive the gray scale output and the synchronization signal from said controller, wherein said first driver generates the first switching output for receipt by said first switch based on a first clock signal and the synchronization signal, and generates a plurality of first drive outputs for receipt by the first LED array based on the first clock signal, the gray scale output and the synchronization signal; and wherein the first LED array is driven to emit light by said first switch based on the first switching output and by said first driver through the first drive outputs.

2. The driving device of claim 1, wherein:

the first switching output includes a plurality of switching signals;

said first switch includes a plurality of switches; and each of said switches has a first terminal that is to receive an input voltage, a second terminal that is adapted to be coupled to the first LED array, and a control terminal that is coupled to said first driver to receive a respective one of the switching signals therefrom.

3. The driving device of claim 2, the first LED array including a plurality of LEDs, each of the LEDs having an anode and a cathode, wherein:

said first driver is adapted to be coupled to the cathodes of the LEDs; and said second terminal of each of said switches is adapted to be coupled to the anodes of corresponding ones of the LEDs.

4. The driving device of claim 1, wherein:

the first switching output includes a plurality of switching signals;

said first driver is to further receive an input voltage, and to acquire the first drive outputs from the input voltage;

said first switch includes a plurality of switches; and each of said switches has a first terminal that is to receive a ground voltage, a second terminal that is adapted to be coupled to the first LED array, and a control terminal that is coupled to said first driver to receive a respective one of the switching signals therefrom.

5. The driving device of claim 4, the first LED array including a plurality of LEDs, each of the LEDs having an anode and a cathode, wherein:

said first driver is adapted to be coupled to the anodes of the LEDs; and said second terminal of each of said switches is adapted to be coupled to the cathodes of corresponding ones of the LEDs.

6. The driving device of claim 1, wherein:

said first driver generates a number (M) of the first clock signals;

said first driver includes a number (M) of first driver chips, where $M \geq 2$; and each of said first driver chips generates a respective one of the first clock signals.

7. The driving device of claim 6, wherein:

the gray scale output includes a second clock signal and a serial input signal;

each of said first driver chips has a drive output pin set that provides a respective one of the first drive outputs, a switching output pin set, a control input pin, a control output pin, a gray scale input pin, a gray scale output pin, a synchronization pin, and a clock pin that is coupled to said controller to receive the second clock signal;

for a first one of said first driver chips, said drive output pin set thereof is adapted to be coupled to the first LED array, said switching output pin set thereof is coupled to said first switch, said control input pin thereof is to receive a predetermined bias voltage, and said gray scale input pin thereof and said synchronization pin thereof are coupled to said controller to respectively receive the serial input signal and the synchronization signal;

said first one of said first driver chips generates the first switching output based on the first clock signal generated thereby and the synchronization signal, generates the respective one of the first drive outputs based on the first clock signal generated thereby, the second clock signal, the serial input signal and the synchronization signal, and generates a control signal that contains synchronization pulses of the synchronization signal and a line scan command which indicates when the respective one of the first drive outputs changes;

said first one of said first driver chips outputs the first switching output at said switching output pin set thereof, outputs the respective one of the first drive outputs at said drive output pin set thereof, outputs the control signal at the control output pin thereof, and outputs the serial input signal at the gray scale output pin thereof;

for an $m^{th}$ one of said first driver chips, said drive output pin set thereof is adapted to be coupled to the first LED array, said control input pin thereof is coupled to said control output pin of said first one of said first driver chips to receive the control signal, said gray scale input pin thereof is coupled to said gray scale output pin of an $(m-1)^{th}$ one of said first driver chips to receive the serial input signal, and said synchronization pin is coupled to ground, where $2 \leq m \leq M$; and said $m^{th}$ one of said first driver chips generates the respective one of the first drive outputs based on the first clock signal generated thereby, the second clock signal, the serial input signal and the control signal, outputs the respective one of the first drive outputs at said drive output pin set thereof, and outputs the serial input signal at the gray scale output pin thereof.

8. The driving device of claim 7, further operatively associated with a second LED array, and further comprising:

a second switch adapted to be coupled to the second LED array, to receive a second switching output, and to switch among different conduction states based on the second switching output; and a second driver chip coupled to said controller, said first driver and said second switch, adapted to be further coupled to the second LED array, to receive the second clock signal from said controller, and to further receive the serial input signal and the control signal from said first driver, wherein said second driver chip generates the second switching output for receipt by said second switch based on a respective first clock signal and the control signal, and generates a second drive output for receipt by the second LED array based on the respective first clock signal, the second clock signal, the serial input signal and the control signal; and wherein the second LED array is driven to emit light by said second switch based on the second switching output and by said second driver chip through the second drive output.

9. The driving device of claim 6, wherein:

the gray scale output includes a second clock signal and a serial input signal;

each of said first driver chips has a drive output pin set that provides a respective one of the first drive outputs, a switching output pin set, a control input pin, a control output pin, a gray scale input pin, a gray scale output pin, a synchronization pin, and a clock pin that is coupled to said controller to receive the second clock signal;

for a first one of said first driver chips, said drive output pin set thereof is adapted to be coupled to the first LED array, said switching output pin set thereof is coupled to said first switch, said control input pin thereof is to receive a predetermined bias voltage, and said gray scale input pin thereof and said synchronization pin thereof are coupled to said controller to respectively receive the serial input signal and the synchronization signal;

said first one of said first driver chips generates a first part of the first switching output based on the first clock signal generated thereby and the synchronization signal, generates the respective one of the first drive outputs based on the first clock signal generated thereby, the second clock signal, the serial input signal and the synchronization signal, and generates a control signal that contains synchronization pulses of the synchronization signal and a line scan command which indicates when the respective one of the first drive outputs changes;

said first one of said first driver chips outputs the first part of the first switching output at said switching output pin set thereof, outputs the respective one of the first drive outputs at said drive output pin set thereof, outputs the control signal at the control output pin thereof, and outputs the serial input signal at the gray scale output pin thereof;

for an $m^{th}$ one of said first driver chips, said drive output pin set thereof is adapted to be coupled to the first LED array, said control input pin thereof is coupled to said control output pin of said first one of said first driver chips to receive the control signal, said gray scale input pin thereof is coupled to said gray scale output pin of an (m-1)th one of said first driver chips to receive the serial input signal, and said synchronization pin is coupled to ground, where $2 \leq m \leq M$;

said $m^{th}$ one of said first driver chips generates the respective one of the first drive outputs based on the first clock signal generated thereby, the second clock signal, the serial input signal and the control signal, outputs the respective one of the first drive outputs at said drive output pin set thereof, and outputs the serial input signal at the gray scale output pin thereof; and a predetermined one of a second to $M^{th}$ ones of said first driver chips generates a second part of the first switching output based on the first clock signal generated thereby and the control signal, and outputs the second part of the first switching output at said switching output pin set thereof.

10. The driving device of claim 9, wherein:

the first switching output includes a number (P) of switching signals, where $P \leq 2$;

said switching output pin set of each of said first driver chips includes a number (P) of switching output pins;

half of said switching output pins of said first one of said first driver chips are coupled to said first switch;

said first one of said first driver chips generates half of the switching signals, and outputs said half of the switching signals at said half of said switching output pins thereof;

half of said switching output pins of said predetermined one of said second to $M^{th}$ ones of said first driver chips are coupled to said first switch; and said predetermined one of said second to $M^{th}$ ones of said first driver chips generates the other half of the switching signals, and outputs said other half of the switching signals at said half of said switching output pins thereof.

11. The driving device of claim 10, wherein:

said first switch includes a number (P) of switches;

each of said switches is coupled to a corresponding one of said switching output pins of said first one of said first driver chips and said predetermined one of said second to $M^{th}$ ones of said first driver chips to receive a respective one of the switching signals therefrom, and transitions between conduction and non-conduction based on the respective one of the switching signals; and the switching signals are generated in such a way that said switches conduct one by one.

12. The driving device of claim 9, wherein:

the first switching output includes a number (P) of switching signals, where $P \leq 2$;

said switching output pin set of each of said first driver chips includes a number (P/2) of switching output pins;

said switching output pins of said first one of said first driver chips and said predetermined one of said second to $M^{th}$ ones of said first driver chips are coupled to said first switch;

said first one of said first driver chips generates half of the switching signals, and outputs said half of the switching signals at said switching output pins thereof; and said predetermined one of said second to $M^{th}$ ones of said first driver chips generates the other half of the switching signals, and outputs said other half of the switching signals at said switching output pins thereof.

13. The driving device of claim 12, wherein:

said first switch includes a number (P) of switches;

each of said switches is coupled to a respective one of said switching output pins of said first one of said first driver chips and said predetermined one of said second to $M^{th}$ ones of said first driver chips to receive a respective one of the switching signals therefrom, and transitions between conduction and non-conduction based on the respective one of the switching signals; and the switching signals are generated in such a way that said switches conduct one by one.

* * * * *